United States Patent [19]

Johnson

[11] 4,318,454

[45] Mar. 9, 1982

[54] FAST ACTING VICE

[76] Inventor: Robert L. Johnson, P.O. Box 693, Sebree, Ky. 42455

[21] Appl. No.: 157,476

[22] Filed: Jun. 9, 1980

[51] Int. Cl.[3] ..... E06C 5/32

[52] U.S. Cl. ..... 182/129; 182/230; 248/210; 269/254 CS

[58] Field of Search ..... 182/129, 230; 269/254 R, 254 CS, 55, 56; 248/210

[56] References Cited

U.S. PATENT DOCUMENTS

| | | | |
|---|---|---|---|
| 2,398,617 | 4/1946 | Casey | 182/129 |
| 2,451,020 | 10/1948 | Davis | 248/210 |
| 2,473,160 | 6/1949 | Madrigal | 269/254 CS |
| 2,529,452 | 11/1950 | Janes | 269/254 CS |
| 3,887,034 | 6/1975 | Sawatzky | 182/129 |
| 4,099,693 | 7/1978 | Blann | 248/210 |

*Primary Examiner*—Reinaldo P. Machado
*Attorney, Agent, or Firm*—Andrew S. Neely

[57] ABSTRACT

The specification discloses a vice jaw 22 mounted in a vice housing 28. The jaw 22 includes a slidearm 44 for sliding within a slideway 46 in the vice housing. A plurality of jaw teeth are formed on the underside of the slidearm 44 and engage one or more housing teeth 50 to operate in a ratchet action. A spring 54 continuously urges the jaw 22 towards a closed or retracted position. When an object is placed in the jaw 22, the jaw teeth 48 and the housing teeth 50 are engaged and will prevent the jaw 22 from moving toward the extended position, but will allow the jaw 22 to move toward the retracted position.

18 Claims, 4 Drawing Figures

FAST ACTING VICE

FIELD OF INVENTION

The present invention relates to fast acting vices for clamping and holding objects, and particularly relates to a fast acting ladder vice having a jaw selectively operable in a ratchet action.

BACKGROUND OF INVENTION

In the construction industry, and particularly in the electrical construction industry, there is a frequent need to cut conduit. This cut is usually performed with a hacksaw. The electrician on the job site must hold the conduit pipe in one hand and saw it with the other hand. If the electrician allows the pipe to roll, the hacksaw blade will jump out of the saw groove causing a slight delay. If the pipe twists laterally in the hand of the electrician, the hacksaw blade will bind, and often it will bind and break. A common technique of the electrician is to use their thumb placed longitudinally on the pipe to prevent the pipe from twisting. Usually this technique results in sore thumbs and broken hacksaw blades. If a corner is nearby, the electrician often places one end of the pipe in the corner for a brace. Practically any other substantial structure is also searched out and used by electricians as a brace for the pipe. Electricians waste a lot of valuable and expensive time cutting pipe for conduit and replacing broken hacksaw blades.

Thus, a need exists for a quick and easy technique or tool for holding conduit while it is cut on the job site during construction. The present invention fulfills such need by providing a quick acting and easy to use tool for holding the pipe or conduit while it is being cut. In the preferred embodiment of the present invention, a pair of fast acting, ratcheted, spring operated vices are mounted on the electrician's ladder. The vices are designed to be opened and locked in the open position with one hand, and the vices will automatically close and clamp against the conduit or pipe placed in the vices.

SUMMARY OF INVENTION

In accordance with the present invention, a vice is provided for holding and gripping an object. The vice includes a vice housing and a vice jaw that is supported by the vice housing and is moveable in and out of the housing between an extended position and a retracted position. The vice jaw is continuously biased, such as by a spring, towards the retracted position for clamping the vice jaw against an object that may be placed in the jaw. In this manner the vice jaw is operable to grip an object. A plurality of teeth are formed along one side of the vice jaw, and at least one housing tooth is formed in the vice housing for engaging the jaw teeth. The jaw teeth and the housing tooth are oriented to prevent movement of the jaw towards the extended position when the jaw teeth and the housing tooth are engaged. The vice jaw may be pulled out of the vice housing towards the extended position only when the jaw teeth and the housing are disengaged.

In the preferred embodiment, the jaw teeth are formed along the underside of the vice jaw, and the housing tooth is formed below the vice jaw. In this orientation, the weight of an object placed in the vice jaw forces the jaw teeth downwardly to engage the housing tooth. The jaw teeth are inclined outwardly towards the extended position and the housing tooth is inclined inwardly towards the retracted position. When engaged in this configuration, the jaw teeth and the housing tooth operate as a ratchet allowing the jaw to move towards the retracted position and blocking the jaw from moving towards the extended position.

In accordance with another aspect of the invention, a notch is formed in the upper side a rear portion of the jaw, and an engagement surface is provided on the housing disposed above the notch for selectively engaging the notch. In the extended position the forward end of the jaw is moveable in an upward direction so that the notch may be placed into engagement with the housing surface by moving the jaw to the extended position and then cocking the jaw upwardly. A spring is connected to the jaw biasing it towards the retracted position, and is operable to urge the notch against the housing surface to hold the jaw in the cocked extended position. When a downward force is placed on the jaw, such as by placing an object in the jaw, the jaw and the notch are forced downwardly and the notch is disengaged from the housing surface to release the jaw for movement towards the retracted position.

In accordance with another aspect of the present invention, a vice housing is mounted on a ladder having at least two generally upright ladder legs and having a plurality of rungs extending between the ladder legs in a spaced apart relationship. A vice jaw extends from the vice housing for selectively clamping and supporting an object on the ladder. In the preferred embodiment, the vice housing has a slideway formed therein, and the jaw includes a gripping surface having a generally vertical orientation for clamping and holding the object. A slide arm forms a portion of the jaw and is disposed in the slideway, thereby, mounting the jaw in the vice housing. The slide arm is operable to slide within the slideway between a retracted position and an extended position. A ratchet mechanism operates on the jaw, and preferably operates on the slide arm of the jaw, for selectively preventing the jaw from moving towards the extended position.

BRIEF DESCRIPTION OF THE DRAWINGS

The present invention may best be understood by those of ordinary skill in the art by reference to the Detailed Description when considered in conjunction with the accompanying Drawings in which.

DETAILED DESCRIPTION

Figure 1:
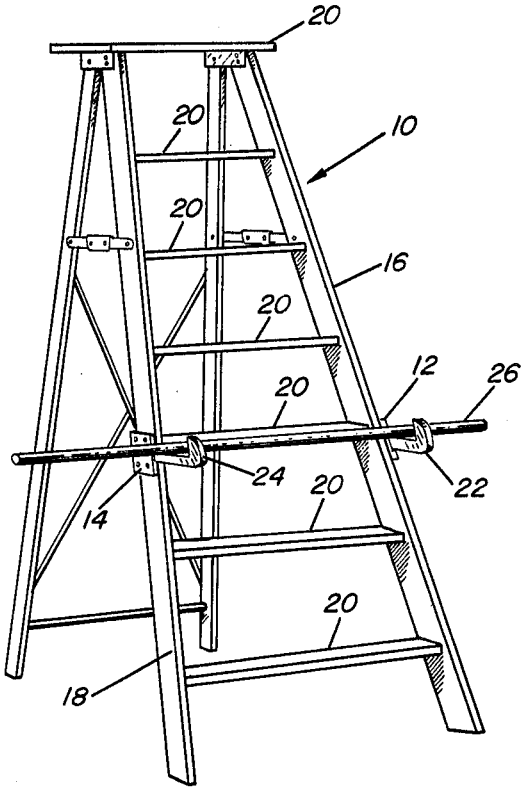
FIG. 1 is a perspective view of a ladder with a pair of ladder vices of the present invention mounted on the ladder holding a pipe conduit.

Referring now to the Drawings in which like reference characters designate like or corresponding parts throughout the several views, there as shown in FIG. 1 a ladder 10 having a pair of vices 12 and 14 mounted thereon. The ladder 10 is a standard wooden electrician's stepladder having two generally upright ladder legs 16 and 18 with a plurality of ladder rungs 20 extending therebetween.

The ladder vices 12 and 14 are mounted on the ladder legs 16 and 18, respectively, adjacent the ends of the third rung 20 from the bottom of the ladder. The ladder vices 12 and 14 may be mounted anywhere along the ladder legs 16 and 18, but in the preferred embodiment the ladder vices should be mounted adjacent to the ends of ladder rungs, usually the second, third or fourth ladder rung from the bottom of the ladder, so that the rung may be used to steady pipe held by the vices.

The ladder vices 12 and 14 include vice jaws 22 and 24 that extend outwardly from the ladder legs 16 and 18 for grasping an object such as a pipe conduit 26 against the ladder 10. The jaws 22 and 24 should normally be aligned with the ladder rung 20 so that a foot or hand may be placed on the conduit 26 and the rung 20 adjacent thereto for bracing the pipe 26 as it is supported by the vice jaws 22 and 24. Such bracing facilitates the process of cutting the conduit 26 held in the vices 12 and 14.

The ladder vices 12 and 14 may be mounted on the ladder legs 16 and 18 by many types of conventional fasteners, such as bolts, wood screws, metal screws, clasps or clamps. In the preferred embodiment, the ladder vices 12 and 14 are bolted or screwed to wooden ladder. Most wooden ladders include tension support rods extending beneath each ladder rung. The support rods extend through the ladder legs 16 and 18 immediately under the ladder rungs 20. A nut is then placed on at least one end of the support rod to secure and tension it between the ladder legs 16 or 18. In this construction, the support rod and the nut protrude from the side of the ladder and it is necessary to use a spacing bracket or to place a void in the ladder vices 12 and 14 in order to mount the ladder vices 12 and 14 immediately adjacent to the ends of the rungs 20. Alternatively, the ladder 10 may be constructed with the support rods fastened to the ladder by nuts or other fasteners that are recessed into the ladder so that no protrusions are formed on the outside surfaces of the ladder legs 16 and 18.

Figure 2:
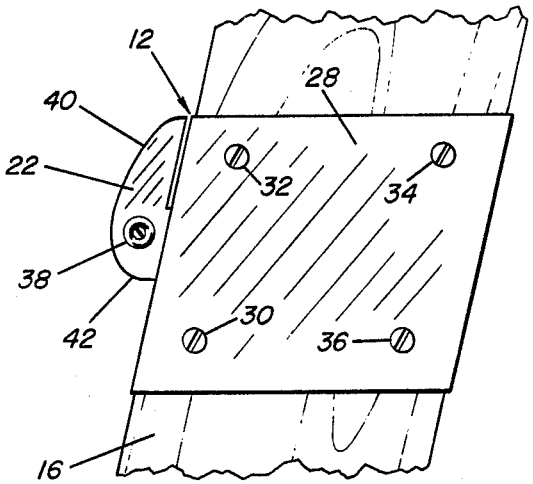
FIG. 2 is a side view of the vice mounted on a ladder leg showing the vice jaw in a closed position.

Referring now to FIG. 2 there is shown a more detailed view of the ladder vice 12 mounted on the ladder leg 16. The ladder vice 12 is constructed of two basic parts, a vice housing 28 and a vice jaw 22. The vice housing 28 is secured to the ladder leg by four bolts or wood screws, 30, 32, 34 and 36.

A short handle 38 extends from the side of the jaw 22 for use in pulling the jaw from the vice housing 28. In the preferred embodiment, the handle is threaded and screwed into a threaded aperture in the jaw. In this manner, the handle can be removed if desired.

The jaw 22 and the vice housing 28 are shaped to enhance safety. When the jaw 22 is in a fully retracted position, it forms a smooth contour with respect to the ladder leg 16. The upper portion 40 and the lower portion 42 of the jaw 22 are tapered towards the ladder leg 16 so that there are no abrupt protrusions or catch surfaces on which to snag a pant leg. The edges and corners of the vice housing 28 are likewise contoured to minimize the risk of snagging a pant leg, and, if desired, the handle 38 may be removed to further enhance safety.

Figure 3:
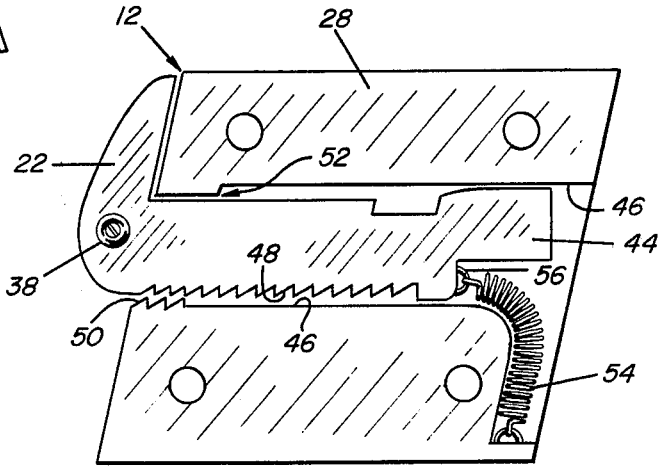
FIG. 3 is a somewhat diagrammatical view of the vice showing the vice jaw in the retracted position with portions of the vice removed to show the interior construction of the vice.

Referring now to FIG. 3, there is shown a somewhat diagrammatical view of the interior of the vice 12. The jaw 22 includes a generally horizontal slidearm 44 disposed within a generally horizontal slideway 46 in the vice housing 28. A plurality of the jaw teeth 48 are formed along the underside of the slidearm 44 and are inclined pointing downwardly and outwardly with respect to the vice housing 28. The jaw teeth 48 are, thus, pointing toward the extended position. Three housing teeth 50 are formed on the vice housing 28 in the slideway 46. The housing teeth 50 are configured to mate and mesh with the jaw teeth 48 and are inclined inwardly (towards the retracted position) so that the jaw teeth 48 and the housing teeth 50, when engaged, operate in a ratchet action whereby the jaw and housing teeth will prevent the jaw 22 from moving towards the extended position, but the inclination of the teeth will allow the jaw 22 to move rearwardly in a ratchet action towards the retracted position. When an object is placed in the jaw 22 as shown in FIG. 1, the downward weight of the object will force the jaw teeth 48 downwardly to engage the housing teeth 50 for operation in the ratchet action.

The slideway 46 is dimensioned to provide a space 52 sufficient to allow the jaw teeth 48 and the housing teeth 50 to be disengaged by lifting or cocking the forward end of the jaw 22 upwardly. The jaw 22 may, thus, be lifted upwardly and pulled out of the vice housing 28 toward the extended position.

A spring 54 has one end secured to the vice housing 28, and the other end of the spring 54 is connected to a loop 56 near the rearward end of the jaw 22. The function of the spring 54 is to continuously bias the jaw 22 towards the retracted position. When the vice 12 is not in use, the spring 54 will hold the jaw 22 in a fully retracted position. However, when the vice 12 is in use, the spring 54 will continuously urge the jaw 22 towards the retracted position, and, thus, will clamp the jaw 22 against an object placed therein.

Figure 4:
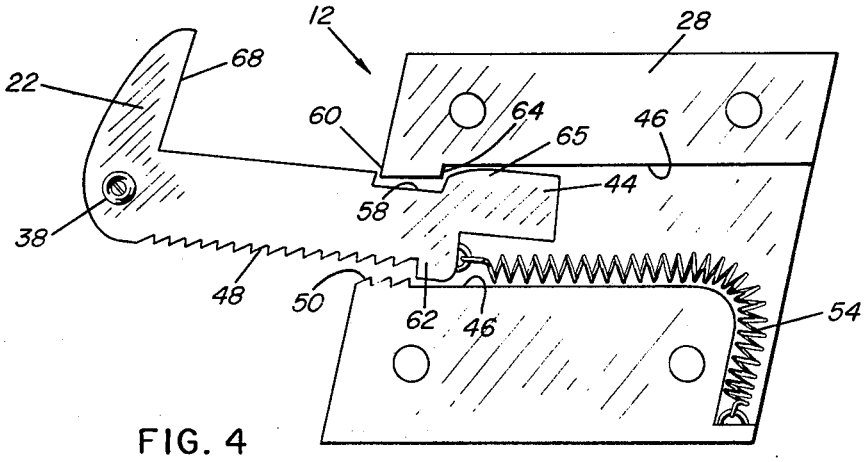
FIG. 4 is a somewhat diagrammatical cutaway view of the vice showing the vice jaw in the fully extended and cocked position with a notch in the vice jaw engaging a surface on the vice housing to hold the jaw in the extended position.

Referring now to FIG. 4, there is shown a somewhat diagrammatical view of the vice 12 with the jaw 22 in the fully extended and locked position. The slidearm 44 has a notch 58 formed in the upper side of the slidearm adjacent to the rear end thereof. When the jaw 22 has been pulled to the fully extended position, the jaw may be cocked upwardly so that the front edge of the notch engages an engagement or catch surface 60 on the vice housing 28. Since the spring 54 is urging the slidearm 44 towards the retracted position, the notch 58 engages the catch surface 60 and holds the jaw 22 in the open position. The clamping action or friction forces between the catch surface 60 and the notch 58 holds the jaw in the cocked position and prevents it from dropping out of engagement with the catch surface 60.

When an object is placed in the jaw 22, the slidearm 44 is forced downwardly until the notch 58 disengages the catch surface 60, and the jaw teeth 48 and housing teeth 50 will engage. The spring 54 will then pull the jaw 22 towards the retracted position, while the teeth 48 and 50 operate in a ratchet action. The jaw 22 will continue to move towards the retracted position until the object placed in the jaw is clamped against the catch surface 60 and/or the ladder leg 16 by the jaw 22. A generally vertical grip surface 68 is formed on the jaw 22 for clamping and holding objects placed in the jaw. If the vice 12 is mounted on the ladder leg 16, the grip surface 68 clamps the object (such as the conduit 26) in the jaw 22 against the catch surface 60 and the ladder leg 16.

The movement of the jaw 22 towards the extended position is limited by a lower stop 62. The stop 62 extends downwardly from the rear end of the slidearm 44.

When the jaw 22 is pulled forward toward the extended position, the stop 62 will engage the housing teeth 50 to prevent the jaw 22 from being pulled completely from the slideway 46. The lower stop 62 also positions or aligns the jaw 22 in the correct position so that the jaw may be rotated or cocked upwardly to engage the notch 58 with the catch surface 60.

A housing stop 64 is formed protruding downwardly from the upper edge of the slideway 46, and a corresponding upper stop 65 is formed on the upper rear portion of the slidearm 44. The stops 64 and 65 also engage one another to limit the outward movement of the jaw 22 and to align the notch 58 with the catch surface 60.

In the preferred embodiment, the jaw teeth 48 are cut into the jaw 22 at a linear density of approximately 16 teeth per inch. Thus, the jaw teeth 48 are spaced at approximately one sixteenth of an inch apart so that the maximum play that the ratchet action between the jaw teeth 48 and the housing teeth 50 will allow is approximately one sixteenth of an inch, and the average play allowed is approximately one thirty-second of an inch. In the preferred embodiment, the jaw teeth 48 are positioned on the jaw 22 relative to the clamping surface 68 so that the clamping surface 68 will clamp securely against the outside diameter of standard size conduit (such as conduit 26) with a minimum of play allowed.

To provide a durable tool, both the jaw teeth 48 and the housing teeth 50 should be made of a strong, hard material that is not brittle and resist breakage such as high quality, high carbon steel. The remaining portions of the vice housing 28 could be made of a less expensive material such as a lower quality steel, or other metal, or even a high strength plastic.

Although the vice 12 of the present invention has been described as a ladder vice, it will be appreciated that the vice may be mounted on other objects, such as a scaffold, or a bracket on a workbench. It is also anticipated that larger or smaller sizes of the vice 12 may be appropriate for differing applications, and that different types of ratchet mechanisms may be used in the vice 12.

Although a preferred embodiment has been described in the foregoing Detailed Description, it will be understood that the invention is capable of numerous rearrangements, modifications and substitution of parts without departing from the spirit of the invention.

I claim:

1. A vice for gripping and holding an object comprising:

a vice housing;

a vice jaw supported in said vice housing and being moveable in and out of said vice housing between an extended and a retracted position, said vice jaw being operable to grip an object;

biasing means for continuously urging said vice jaw toward the retracted position for clamping said vice jaw against an object;

a plurality of jaw teeth formed along one side of the vice jaw; and at least one housing tooth formed in said vice housing for engaging said jaw teeth, said jaw teeth and said housing tooth being oriented to prevent movement of said jaw toward the extended position when said jaw teeth and said housing tooth are engaged so that said vice jaw may be pulled out of said vice housing only when the jaw teeth and the housing tooth are disengaged.

2. The vice of claim 1 wherein:

said jaw teeth are formed along the underside of said vice jaw; and said housing tooth is formed below said jaw and said jaw teeth so that the weight of an object in the jaw forces the jaw teeth to engage the housing tooth to prevent the jaw from moving toward the extended position.

3. The vice of claim 1 wherein:

said jaw teeth are inclined outwardly towards the extended position; and said housing tooth is inclined inwardly toward the retracted position so that said jaw teeth and housing tooth operate as a ratchet for allowing the jaw to move toward the retracted position and for blocking the jaw from moving towards the extended position.

4. The vice of claim 1 wherein said biasing means is a spring for continuously urging said jaw towards the retracted position.

5. The vice of claim 1 further comprising a catch operable between said jaw and said jaw housing to selectively hold said jaw in the extended position.

6. The vice of claim 5 wherein said catch comprises:

a notch formed in the upper side of said jaw; and an engagement surface on said housing disposed above said jaw for selectively engaging said notch, said jaw being moveable in an upward direction so that said notch may be placed into engagement with said engagement surface by moving said jaw to the extended position and cocking the jaw upwardly, said spring being operable to urge said notch against said engagement surface to hold said jaw in the cocked and extended position, and so that a downward force on said jaw disengages said notch from said engagement surface and releases said jaw.

7. The vice of claim 1 further comprising a handle extending from the side of said jaw for use in pulling said jaw from said vice housing.

8. A vice for gripping and holding an object comprising:

a vice housing having a slideway formed therein;

a jaw mounted in said vice housing and being moveable between an extended position and a retracted position;

a gripping surface formed on said jaw for clamping and holding an object;

said jaw including a slidearm for being disposed in said slideway to mount said jaw in said vice housing, said slidearm being operable to slide within said slideway to move said jaw between a retracted position and an extended position;

and a ratchet mechanism operating on said jaw for selectively preventing said jaw from moving toward the extended position.

9. The vice of claim 8 wherein said ratchet mechanism comprises:

a plurality of jaw teeth formed along said slidearm and being inclined pointing toward the extended position, and at least one fixed housing tooth disposed adjacent said slidearm for engaging said jaw teeth on said slidearm and being inclined pointing towards the retracted position so that said fixed housing tooth and said jaw teeth operate as a ratchet when engaged to allow said slidearm to move toward the retracted position and to prevent said slidearm from moving toward the extended position.

10. The vice of claim 9 wherein said jaw teeth are disposed on the underside of said slidearm and said fixed housing tooth is disposed on said vice housing in said slideway immediately below said slidearm so that the weight of an object placed in said jaw forces said jaw teeth downwardly into engagement with said fixed housing tooth.

11. The vice of claim 8 further comprising a spring attached between said vice housing and said vice jaw for continuously urging said vice jaw toward the retracted position.

12. The vice of claim 8 further comprising a catch for holding said jaw in the fully extended position.

13. The vice of claim 12 wherein said catch comprises:

a notch formed in the upper side of said slidearm; and an engagement surface formed on said slideway housing for engaging said notch to hold said jaw in the extended position.

14. The vice of claim 13 further comprising a stop extending from the rear underside of said slidearm for engaging the fixed tooth in said vice slideway to limit the travel of said slidearm toward the extended position and for aligning said notch with said engagement surface.

15. An improvement in a ladder having at least two generally upright ladder legs and having a plurality of rungs extending between the ladder legs in a spaced apart relationship, said improvement comprising:

at least one vice housing mounted on said ladder leg; and at least one vice jaw extending from said vice housing and being moveable between an extended position and a retracted position for selectively clamping an object adjacent the ladder.

16. The improvement of claim 15 further comprising a ratchet mechanism operating on said jaw for selectively preventing said jaw from moving toward the extended position.

17. The improvement of claim 15 wherein:

said vice housing has a slideway formed therein; and said jaw includes a slidearm disposed in said slideway and being operable to slide within said slideway to move said jaw between the retracted position and the extended position.

18. The improvement of claim 17 further comprising:

a plurality of jaw teeth formed along the underside of said slidearm and being inclined pointing towards the extended position;

at least one fixed housing tooth disposed adjacent said slidearm for selectively engaging said jaw teeth on said slidearm and being inclined pointing towards the retracted position so that said fixed housing tooth and said jaw teeth operate in a ratchet action when engaged to allow said slidearm to move toward the retracted position and to prevent said slidearm from moving toward the extended position; and a spring connected to said slidearm for continuously urging said slidearm toward the retracted position.

* * * * *